US011181272B2

(12) United States Patent
Tentorio et al.

(10) Patent No.: US 11,181,272 B2
(45) Date of Patent: Nov. 23, 2021

(54) SPRAY NOZZLE

(71) Applicant: ROLLS-ROYCE plc, London (GB)

(72) Inventors: Luca Tentorio, Derby (GB); Carl L Muldal, Derby (GB); Hua Wei Huang, Derby (GB); Evangelos Bacharoudis, Derby (GB); Juan Carlos Roman Casado, Derby (GB)

(73) Assignee: ROLLS-ROYCE plc, London (GB)

( * ) Notice: Subject to any disclaimer, the term of this patent is extended or adjusted under 35 U.S.C. 154(b) by 190 days.

(21) Appl. No.: 16/119,496

(22) Filed: Aug. 31, 2018

(65) Prior Publication Data

US 2019/0078784 A1 Mar. 14, 2019

(30) Foreign Application Priority Data

Sep. 8, 2017 (GR) ..... 20170100411
Oct. 10, 2017 (GB) ..... 1716585

(51) Int. Cl.
*F23R 3/30* (2006.01)
*F23R 3/14* (2006.01)
(Continued)

(52) U.S. Cl.
CPC ..... *F23R 3/30* (2013.01); *F23D 11/107* (2013.01); *F23D 11/383* (2013.01); *F23R 3/14* (2013.01);
(Continued)

(58) Field of Classification Search
CPC ..... F23R 3/14; F23R 3/30; F23R 3/34; F23R 3/283; F23R 3/343; F23R 3/346; F23D 14/48; F23D 2900/11101
See application file for complete search history.

(56) References Cited

U.S. PATENT DOCUMENTS 6,068,470 A 5/2000 Zarzalis et al.
6,460,344 B1 10/2002 Steinthorsson et al.
(Continued)

FOREIGN PATENT DOCUMENTS

EP 0 678 708 A2 10/1995
EP 1 331 441 A1 7/2003
(Continued)

OTHER PUBLICATIONS

Nov. 9, 2018 Extended Search Report issued in European Patent Application No. 18191781.6.
(Continued)

*Primary Examiner* — Scott J Walthour
*Assistant Examiner* — David P. Olynick
(74) *Attorney, Agent, or Firm* — Oliff PLC

(57) ABSTRACT

A fuel spray nozzle, for atomising liquid fuel in gas, including: an gas passage; a liquid fuel passage; a swirler provided in the gas passage and including vanes such that, when gas passes through the gas passage, the swirler produces a jet flow of gas from between adjacent vanes and a turbulent flow of gas in the wake of each vane; a prefilming surface for receiving liquid fuel from the liquid fuel passage, and gas from the gas passage, wherein the prefilming surface includes areas that receive jet flow of gas from the gas passage, in use; wherein the fuel spray nozzle is configured to direct the liquid fuel passing through the liquid fuel passage to the areas on the prefilming surface that receive a jet flow of gas from the gas passage.

13 Claims, 5 Drawing Sheets

(51) Int. Cl.
*F23D 11/10* (2006.01)
*F23D 11/38* (2006.01)
*F23R 3/28* (2006.01)

(52) U.S. Cl.
CPC ..... *F05D 2210/11* (2013.01); *F05D 2210/13* (2013.01); *F05D 2210/33* (2013.01); *F23D 2900/11001* (2013.01); *F23R 3/286* (2013.01)

(56) References Cited

U.S. PATENT DOCUMENTS

| | | | | |
|---|---|---|---|---|
| 8,128,007 | B2 * | 3/2012 | Thomson | F23R 3/28 239/405 |
| 2009/0100837 | A1 * | 4/2009 | Von Der Bank | F23R 3/14 60/737 |
| 2009/0173076 | A1 * | 7/2009 | Toon | F23D 14/74 60/746 |
| 2009/0255258 | A1 * | 10/2009 | Bretz | F23D 11/107 60/737 |
| 2010/0050644 | A1 * | 3/2010 | Pidcock | F23R 3/343 60/737 |
| 2010/0115956 | A1 * | 5/2010 | Toon | F23D 11/383 60/742 |
| 2010/0308135 | A1 | 12/2010 | Yamamoto et al. | |
| 2012/0047903 | A1 | 3/2012 | Williams et al. | |
| 2012/0186255 | A1 * | 7/2012 | Parsania | F23R 3/36 60/734 |
| 2012/0305673 | A1 * | 12/2012 | Matsuyama | F23R 3/343 239/533.2 |
| 2014/0291418 | A1 | 10/2014 | Ruffing et al. | |
| 2017/0284678 | A1 * | 10/2017 | Venkatesan | F23R 3/38 |
| 2017/0350598 | A1 * | 12/2017 | Boardman | F23R 3/14 |

FOREIGN PATENT DOCUMENTS

| | | | |
|---|---|---|---|
| EP | 1 584 872 | A2 | 10/2005 |
| EP | 1 750 056 | A2 | 2/2007 |
| GB | 2226123 | A | 6/1990 |
| GB | 2459771 | A | 11/2009 |
| JP | 2005-106411 | A | 4/2005 |

OTHER PUBLICATIONS

Mar. 21, 2018 Search Report issued in Great Britain Patent Application No. GB1716585.3.
Jul. 20, 2018 Search Report issued in Great Britain Patent Application No. GB1716585.3.

* cited by examiner

SPRAY NOZZLE

The present disclosure concerns a fuel spray nozzle, also known as a prefilming airblast spray nozzle.

In gas turbine combustion, prefilming airblast spray nozzles control the quantity and quality of mixing of air and fuel inside the combustor liner of gas turbine engines. To assist the mixing, a system of swirlers (axial or radial) and fuel circuits can be used. The swirlers spin air passing through them, and the fuel circuit can deliver fuel to the prefilmer surfaces of the nozzle as a spinning film. When the fuel and air flows meet at the prefilmer surface, the air flow shears the film towards the trailing edge of the prefilmer surface causing the disintegration of the fuel film into fine droplets.

The characteristics of the air/fuel flow on the prefilmer surfaces and the subsequent atomisation at the prefilmer trailing edge affect the combustion performance. An ideal fuel spray nozzle system would be the one which achieves a uniform atomisation of the film into fine droplets around the periphery of the nozzle.

Generally, although nozzles are designed to provide a uniform atomisation, there are practical limitations to achieving the ideal performance. The present invention aims to improve the quality of the dispersion from a spray nozzle.

According to a first aspect there is provided a fuel spray nozzle, for atomising liquid fuel in a gas, comprising: a gas passage; a liquid fuel passage; a swirler provided in the gas passage and comprising vanes such that, when gas passes through the gas passage, the swirler produces a jet flow of gas from between adjacent vanes and a turbulent flow of gas in the wake of each vane; a prefilming surface configured to receive liquid fuel from the liquid fuel passage, and to receive gas from the gas passage, wherein the prefilming surface comprises areas that, in use, receive jet flow of gas from the gas passage; wherein the fuel spray nozzle is configured to direct the bulk of the liquid fuel passing through the liquid fuel passage to the areas on the prefilming surface that receive a jet flow of gas from the gas passage. By deliberately increasing the amount of fuel supplied to the jet flow of gas, and minimising the amount of fuel supplied to the wake of the vanes, a more uniform droplet size distribution is produced at the trailing edge of the prefilming surface.

The fuel spray nozzle may comprise apertures for supplying liquid fuel to the liquid fuel passage. The apertures may be configured to direct liquid fuel through the liquid fuel passage to the areas on the prefilming surface that receive a jet flow of gas from the gas passage. That is the, direction of the liquid fuel through the nozzle can be controlled by the position and angle of the apertures, so that the bulk of the liquid fuel arrives at the desired location on the prefilming surface.

The number of apertures may be the same as the number of vanes. Each aperture may be positioned angularly between 40% and 60% of the way between the two vanes. Each aperture may be positioned angularly mid-way between two vanes. The angle of the apertures may be substantially the same as the angle of the vanes.

The number of apertures may be an integer multiple of the number of vanes. A plurality of apertures may be positioned angularly between two vanes. The angle of the apertures may be substantially the same as the angle of the vanes. Each of the apertures positioned angularly between two vanes may be positioned angularly at a position between one quarter and three quarters of the way between the two vanes and the apertures positioned angularly between two vanes are angularly spaced.

The number of apertures may be twice the number of vanes. Two apertures may be positioned angularly between two vanes. A first aperture may be positioned angularly at a position between one quarter and one third of the way between the two vanes and a second aperture is positioned angularly at a position between two thirds and three quarters of the way between the two vanes.

The fuel spray nozzle may comprise deflectors within the liquid fuel passage. The deflectors may be configured to direct liquid fuel through the liquid fuel passage to the areas on the prefilming surface that receive a jet flow of gas from the gas passage. That is the, direction of the liquid fuel through the nozzle can be controlled by use of deflectors within the liquid fuel passage, so that the bulk of the liquid fuel arrives at the desired location on the prefilming surface.

The number of deflectors may be the same as the number of vanes. Each deflector may be positioned angularly between 40% and 60% of the way between the two vanes. Each deflector may be positioned angularly mid-way between two vanes. The angle of the deflectors may be substantially the same as the angle of the vanes.

The number of deflectors may be an integer multiple of the number of vanes. A plurality of deflectors may be positioned angularly between two vanes. The angle of the deflectors may be substantially the same as the angle of the vanes. Each of the deflectors positioned angularly between two vanes may be positioned angularly at a position between one quarter and three quarters of the way between the two vanes and the deflectors positioned angularly between two vanes are angularly spaced.

The number of deflectors may be twice the number of vanes. Two deflectors may be positioned angularly between two vanes. A first deflector may be positioned angularly at a position between one quarter and one third of the way between the vanes and a second deflector is positioned angularly at a position between two thirds and three quarters of the way between the vanes.

The gas passage and the liquid fuel passage may be concentric. The liquid fuel passage may be arranged radially outwards of the gas passage.

The fuel spray nozzle may be a fuel spray nozzle for atomising a fuel for combustion in air. The improved uniformity of the droplet size distribution of the fuel in the air leads to better combustion performance.

According to another aspect, there is provided a gas turbine engine incorporating a fuel spray nozzle according to the first aspect.

According to another aspect, there is provided a method of atomising liquid fuel in gas, comprising the steps of: supplying gas to prefilming surface via a swirler, the swirler comprising vanes such that it produces a jet flow of gas from between adjacent vanes and a turbulent flow of gas in the wake of each vane; supplying liquid fuel to the prefilming surface and directing the bulk of the liquid fuel to areas on the prefilming surface that receive a jet flow of gas from the gas passage.

The step of supplying can comprise supplying liquid fuel to a liquid fuel passage via apertures, and supplying liquid fuel from the liquid fuel passage to the prefilming surface, and wherein the apertures are configured to direct liquid fuel through the liquid fuel passage to the areas on the prefilming surface that receive a jet flow of gas from the gas passage.

The step of supplying can comprise supplying liquid fuel from a liquid fuel passage to the prefilming surface, wherein the liquid fuel passage comprises deflectors that are configured to direct liquid fuel through the liquid fuel passage to the areas on the prefilming surface that receive a jet flow of gas from the gas passage.

According to another aspect, there is provided a method of designing a fuel spray nozzle, wherein the fuel spray nozzle comprises: a gas passage; a liquid fuel passage; a swirler provided in the gas passage and comprising vanes such that, when gas passes through the gas passage, the swirler produces a jet flow of gas from between adjacent vanes and a turbulent flow of gas in the wake of each vane; and a prefilming surface configured to receive liquid fuel from the liquid fuel passage, and to receive gas from the gas passage; wherein the method comprises: configuring the fuel spray nozzle to direct the bulk of the liquid fuel passing through the liquid fuel passage to areas on the prefilming surface that receive a jet flow of gas from the gas passage.

The step of configuring can comprise selecting or adjusting one or more of: an angle of the vanes, an angle of liquid fuel passing through the liquid fuel passage, a distance from the swirler to the prefilming surface, and a distance from an entry point of the liquid fuel passage to the prefilming surface.

The step of configuring can comprise selecting or adjusting a number of entry points to the liquid fuel passage, or comprises selecting or adjusting a position of entry points to the liquid fuel passage with respect to the position of vanes of the swirler.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

Embodiments will now be described by way of example only, with reference to the Figures, in which.

Figure 1:
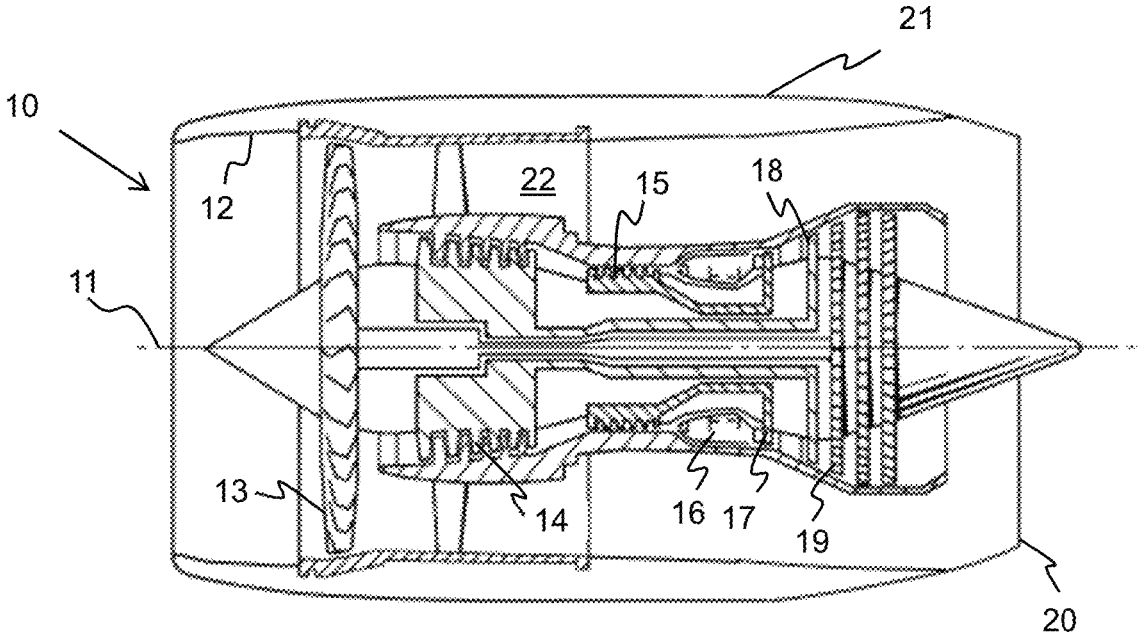
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

Figure 2:
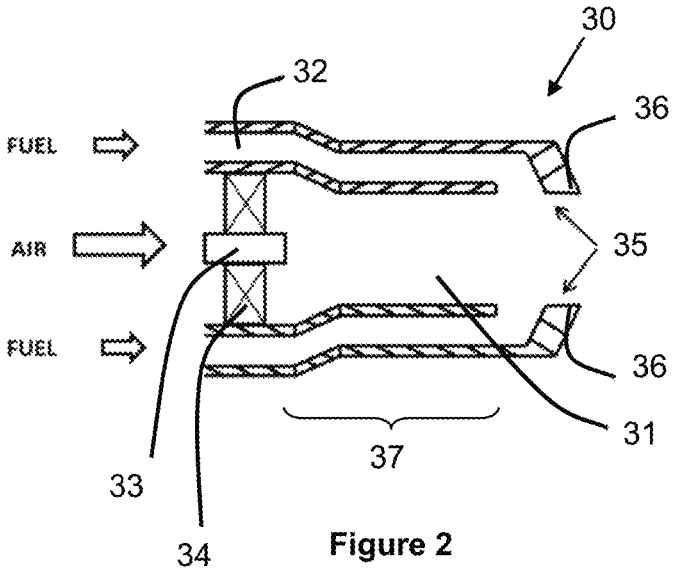
FIG. 2 is a sectional side view of a fuel spray nozzle.

FIG. 2 depicts a spray nozzle 30, specifically fuel spray nozzle, also referred to as a prefilming airblast spray nozzle. Such fuel spray nozzles 30 are used as part of the combustion equipment 16 of the gas turbine engine 10 depicted in FIG. 1, for example. The fuel spray nozzle 30 operates to atomize fuel in air by supplying both the air and fuel through the nozzle 30. This is in contrast, for example, to high pressure nozzles which can be used in other technical fields and which may only supply a liquid (at high pressure) through the nozzle in to the surrounding atmosphere.

In a general spray nozzle 30, gas is provided through a gas passage 31, whilst liquid, is supplied through a liquid passage 32. In the specific example of FIG. 2, the gas used is air and thus the gas passage 31 is an air passage. Similarly, the liquid used is a liquid fuel, and thus the liquid passage 32 is a fuel passage. Those more specific terms are used throughout the description below, for ease of understanding, although the disclosure applies to all types of spray nozzle 30.

In the arrangement of FIG. 2, the fuel passage 32 and the air passage 31 are concentric, with the fuel passage 32 being provided radially outward of the air passage 31. As depicted, fuel and air are supplied to the left-hand side of the nozzle 30, and they exit the nozzle 30 on the right-hand side.

Air passage 31 is provided with a swirler 33. Swirler 33 is a fixed structure within the air passage 31. The swirler 33 is provided with vanes 34. Vanes 34 are angled, such that air passing around the swirler 33 is caused to spin as it progresses through air passage 31 to the prefilming surface 36 (discussed below). The swirler 33 may have any number of vanes 34, but typically the number of vanes 34 can be three to five for example.

Fuel is supplied to the fuel passage 32 through apertures 43 (shown in FIGS. 3 and 4) such as holes or slots. The apertures 43 are arranged to direct fuel through the fuel passage 32 to form a spinning film in the circumferential direction of the nozzle 30. In other words, the apertures 43 are the entry point for the fuel into the nozzle 30.

The section of the fuel passage 32 downstream of the aapertures 43 is known as the spinning chamber 37. The spinning chamber 37 leads to the prefilmer 35, at the exit of the nozzle 30. The prefilmer 35 has a prefilming surface 36 (noting that although FIG. 2 apparently indicates two prefilming surfaces, the circular geometry means that these are actually part of the same circumferential surface).

Figure 3:
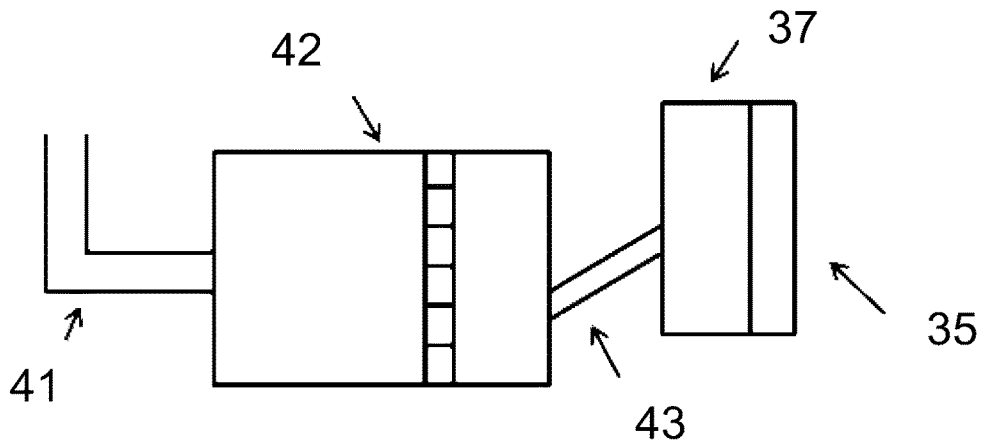
FIG. 3 is a schematic sectional view of a fuel gallery comprising a fuel spray nozzle.

FIG. 3 shows a schematic view of a fuel gallery incorporating a fuel spray nozzle (noting that FIG. 3 shows schematically what takes place in a circular geometry). The gallery comprises a fuel delivery duct 41, which provides fuel initially to a settling chamber 42. The settling chamber 42 feeds the metring holes or slots, which are the apertures 43 for supplying fuel to the fuel passage 32 of the nozzle 30. As can be seen in FIG. 3, the fuel then passes to the spinning chamber 37 and subsequently to the prefilmer 35.

Therefore, in use, fuel provided through the fuel gallery enters the nozzle 30 through the apertures 43 and is caused to form a spinning film in the spinning chamber 37. At the same time, air enters the air passage 31 via the swirler 33. The vanes 34 of the swirler 33 cause the air to spin also. The spinning film of fuel coats the prefilming surface 36 of the prefilmer 35. The air flowing through the air passage 31 meets the fuel at the prefilming surface 36 and sheers the fuel film towards the trailing edge of the prefilming surface 36 and causes the disintegration of the fuel film into fine droplets. This produces a mixture of fuel droplets in air which can then be combusted.

As discussed above, an ideal fuel nozzle would provide an entirely uniform film of fuel to the prefilming surface 36, in conjunction with a uniform flow of air. This would provide a uniform dispersion of the film into droplets, and thus give the best combustion performance. However, practical issues to do with the manufacturing of the fuel nozzle 30, as well as the fluid dynamics of the fuel and air passing through the nozzle 30, mean that in practice the ideal situation is not attained.

Considering the fuel supply system, an ideal nozzle 30 would provide a uniform film to the prefilming surface 36. However, imperfections in the manufacture of the apertures 43 supplying fuel to the nozzle 30, and further imperfections within the fuel passages 32 of the nozzle itself, may result in a non-uniform film being supplied to the prefilming surface 36. Computational fluid dynamics (CFD) studies have revealed that jets from the apertures 43 supplying fuel to the nozzle 30 may persist though the fuel passages 32 of the nozzle 30, resulting in a weakly non-uniform distribution of the velocity magnitude in the circumferential direction around the prefilming surface 36. In other words, the combination of the non-uniformities introduced by the apertures 43 and the engineering uncertainties during manufacture result in a non-uniform fuel film on the prefilmer surface 36.

Considering the air flow, the vanes 34 of the swirlers 33 introduce non-uniformity in the flow around the circumference of the nozzle 30, primarily due to the wakes of the vanes. Experimental and numerical studies confirm this effect. CFD predictions of the air velocity at the exit of the spray nozzle 30 on a plane parallel to its centreline show that the wake generated from each of the vanes of the swirler persists and flows downstream inside the nozzle 30.

Taking into account all the above, in a conventional nozzle non-uniform air flow from the swirlers will encounter a non-uniform fuel film at the prefilmer edge. As a result, a uniform atomisation of the fuel is not achieved, leading to a reduction in combustion performance.

The fuel nozzle 30 of the present disclosure is designed to account for the non-uniformity of the air and fuel flows, and controls the flow of the fuel to provide the practical optimum dispersion of fuel from the prefilming surface despite the non-uniform characteristics of the fuel film and air flow at the prefilming surface 36.

Figure 4:
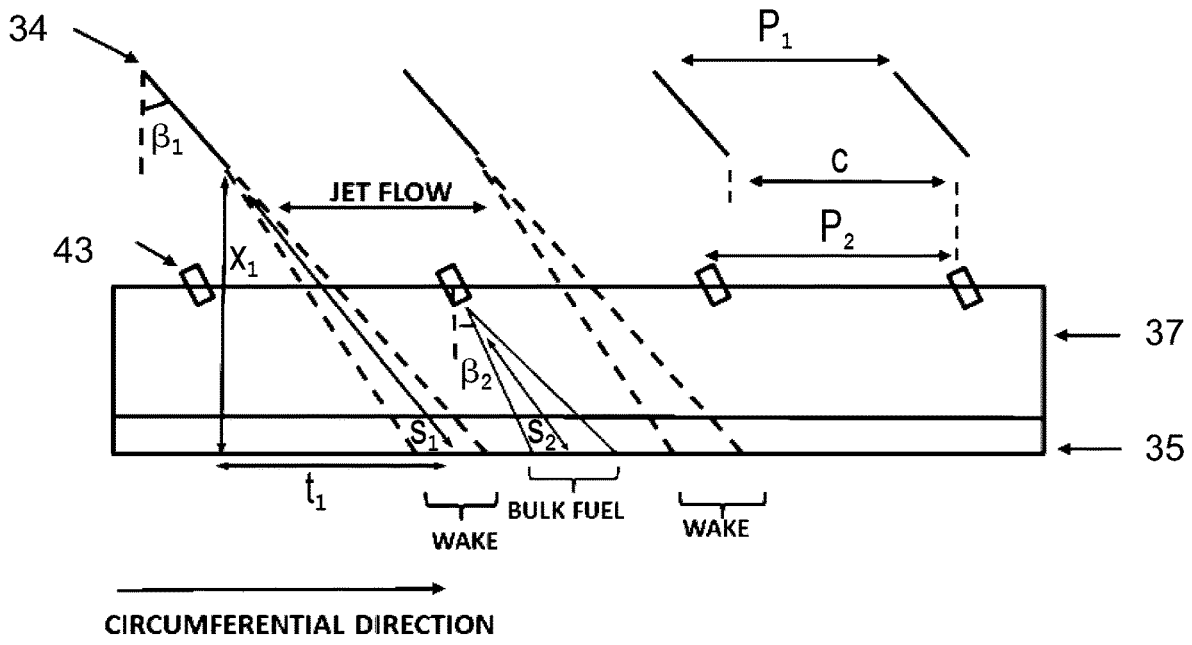
FIG. 4 is a schematic view of the arrangement of swirler vanes and fuel supply around the circumferential direction of a fuel spray nozzle.

FIG. 4 schematically represents a fuel spray nozzle 30 viewed around the circumferential direction. FIG. 4 shows the wall of the prefilmer 35 and spinning chamber 37. Apertures 43 for supplying the fuel to the fuel passage 32 (and thus to the spinning chamber 37) are schematically indicated, as are the angled vanes 34 of the swirler. As depicted in FIG. 4, the vanes 34 have an angle to the axis of flow $\beta_1$, whilst the apertures 43 for fuel entering the fuel passage 32 are arranged at an angle $\beta_2$. The vanes 34 are spaced at a distance $P_1$ (this being the distance at the radial outer point of the vanes 34), whilst the apertures 43 are spaced at a distance $P_2$.

As can be seen from FIG. 4, air entering the nozzle 30 (i.e. from above as depicted from FIG. 4) must pass through an axial distance $x_1$ after leaving the trailing edge of the vanes 34, before it reaches the trailing edge of the prefilmer 35. Due to the angle of the vane 34, the air is also caused to rotate, and therefore also travels a circumferential distance $t_1$ after exiting from the swirler. Therefore, the actual distance travelled by the air is represented by the distance $s_1$. In a similar way, the distance travelled by the fuel, accounting for the circumferential spin, is represented by distance $s_2$.

Air passing through the air passage 31 in close proximity to the vanes 34 forms a turbulent wake downstream of each vane 34. In contrast, air passing through the main space between the vanes 34 of the swirler 33 forms a jet flow (i.e. a substantially laminar flow) between the turbulent wakes. Fuel atomized at the prefilmer 35 in areas on the prefilming surface 36 that receive a jet flow of air is atomized in a relatively uniform manner. However, where the prefilming surface 36 receives the wake of the vanes 34, the turbulent flow of air at the prefilming surface 36 causes poor, very non-uniform, atomisation.

The present disclosure provides a fuel spray nozzle 30 in which the apertures 43 and the angled vanes 34 are arranged such that the bulk of the fuel supplied through the apertures 43 is directed to areas of the prefilming surface 36 that receive a jet flow of air from the air passage 31, rather than the wake from the angled vanes 34. In practice, some spreading of the fuel (and indeed of the wake from the vanes 34) will occur as the fuel progresses through the spinning chamber 37. However, by directing the fuel to the areas of the prefilming surface 36 that receive a jet flow of air, the bulk of the fuel at the prefilming surface can be atomized by the jet flow, providing a relatively uniform atomisation. It should be noted that this increase in uniformity of atomisation (compared to prior art fuel nozzles in which the position of the apertures 43 compared to the angled vanes 34 is not considered) is achieved by exacerbating the circumferential non-uniformity of the fuel supply to the prefilming surface 36. That is, the presently disclosed nozzle 30 deliberately increases the fuel supply to the areas of the prefilming surface 36 that receive the jet flow of air, whilst reducing the fuel supply to the areas of the prefilming surface 36 that receive the wake from the angled vanes 34. Considered in another way, the liquid is deliberately distributed on the prefilming surface 36 in a non-uniform way, so that maxima in the amount of liquid supplied to the prefilming surface 36 occur at positions receiving the jet flow of gas, whilst minima in the amount of liquid supplied to the prefilming surface 36 occur at positions in the wake of the vanes 34.

Preferably, 50% or more of the fuel supplied through the apertures 43 is provided to the areas on the prefilming surface that receive a jet flow of air from the air passage. Even more preferably, 70% or more of the fuel supplied through the apertures 43 is provided to the areas on the prefilming surface that receive a jet flow of air from the air passage. Even more preferably, 90% or more of the fuel supplied through the apertures 43 is provided to the areas on the prefilming surface that receive a jet flow of air from the air passage.

The ideal arrangement of the apertures 43 with respect to the vanes 34 will depend upon the angles of the vanes and the apertures ($\beta_1$, $\beta_2$) as well as the distances between the vanes ($P_1$) (which dictates the number of vanes around the circumference), the distance between the apertures 43 ($P_2$), and also the distances travelled by the air and fuel ($s_1$, $s_2$). Taking these variables into account, CFD studies can determine the ideal rotational offset (i.e. the distance between the trailing edge of the swirler vanes 34 and the centre of the apertures 43, indicated as c in FIG. 4) between the apertures 43 and the vanes 34.

As depicted in FIG. 4, it can be readily recognised that for the scenario in which there is the same number of apertures 43 as vanes 34 (or indeed when the number of apertures 43 is an integer multiple of the number of vanes 34), an offset can be identified which provides the bulk of the fuel entering the spinning chamber 37 such that it reaches the prefilmer 35 within the jet flow. However, even when the number of swirler vanes 34 and apertures 43 are not the same (or the number of apertures 43 is not an integer multiple of the number of vanes 34) then the optimisation process can still identify the optimum orientation to direct the bulk of the fuel to the areas on the prefilming surface 36 that receive a jet flow of air from the air passage 31.

As such, for existing nozzles 30 utilising predefined geometries of swirler vanes 34 and apertures 43, the relative orientation of the swirler vanes 34 and the apertures 43 (i.e. the offset c) can be optimised to provide the best atomisation performance. Alternatively, when designing an entirely new fuel spray nozzle 30, the various parameters identified above can be controlled to provide the best atomisation performance.

Figure 5:
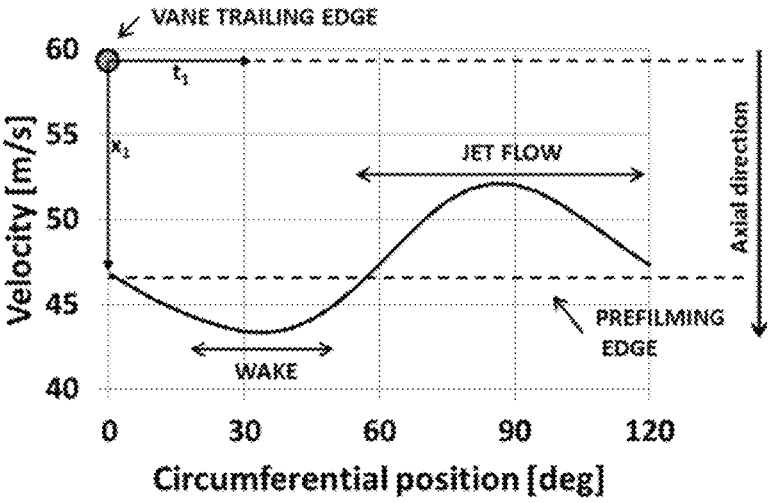
FIG. 5 is a graph showing how air velocity varies in the circumferential direction around the prefilming surface of a fuel spray nozzle.

FIG. 5 shows a graph depicting how the velocity of the air varies at the prefilming edge 36 in the circumferential direction. As can be seen, the graph depicts a 120° section of a prefilming edge of an arrangement in which three angled vanes 34 are used on the swirler 33 (and thus the profile shown in the graph repeats every 120°). In the area of the wake of the vane 34, the bulk velocity is significantly less than the velocity in the jet flow zone (and it should also be noted that the nature of the flow is much more turbulent in the wake). To assist with understanding, the graph of FIG. 5 is also superimposed with information regarding the position of the vane 34 and the arrangement of the nozzle 30, in accordance with FIG. 4.

When the number of apertures 43 is the same as the number of vanes 34, each aperture 43 is positioned angularly mid-way between two vanes 34 or is positioned angularly between 40% and 60% of the way between the two vanes 34. The angle $\beta_2$ of the apertures 43 is the substantially the same as the angle $\beta_1$ of the vanes 34. For example as shown in FIG. 5, there are three vanes 34 and each vane 34 is spaced 120° from the adjacent vanes 34. There are three apertures 43, each aperture 43 is spaced spaced 120° from the adjacent apertures 43 and each apertures 43 is positioned angularly mid-way between two vanes 34, e.g. each aperture 43 is positioned angularly 60° from each of the two vanes 34. If there are four vanes 34 each vane 34 is spaced 90° from the adjacent vanes 34. There are four apertures 43, each aperture 43 is spaced spaced 90° from the adjacent apertures 43 and each apertures 43 is positioned angularly mid-way between two vanes 34, e.g. each aperture 43 is positioned angularly 45° from each of the two vanes 34. If there are five vanes 34 each vane 34 is spaced 72° from the adjacent vanes 34. There are five apertures 43, each aperture 43 is spaced spaced 72° from the adjacent apertures 43 and each apertures 43 is positioned angularly mid-way between two vanes 34, e.g. each aperture 43 is positioned angularly 36° from each of the two vanes 34.

When the number of apertures 43 is an integer multiple of the number of vanes 34, a plurality of apertures 43 are positioned angularly between two vanes 34. The angle $\beta_2$ of the apertures 43 is the substantially the same as the angle $\beta_1$ of the vanes 34. Each of the apertures 43 positioned angularly between two vanes 34 is positioned angularly at a position between one quarter and three quarters of the way between the two vanes 34 and the apertures 43 positioned angularly between two vanes 34 are angularly spaced. If the number of apertures 43 is twice the number of vanes 34 then two apertures 43 are positioned angularly between two vanes 34 and a first aperture 43 is positioned angularly at a position between one quarter and one third of the way between the vanes 34 and a second aperture 43 is positioned angularly at a position between two thirds and three quarters of the way between the vanes 34.

If there are three vanes 34, each vane 34 is spaced 120° from the adjacent vanes 34 and there are six apertures 43, two apertures 43 are positioned angularly between two vanes 34. A first aperture 43 is positioned angularly between one quarter and one third of the way between the vanes 34, e.g. between 30° and 40° positions, and a second aperture 43 is positioned angularly at a position between two thirds and three quarters of the way between the vanes 34, e.g. between 80° and 90° positions.

If there are four vanes 34, each vane 34 is spaced 90° from the adjacent vanes 34 and there are eight apertures 43, two apertures 43 are positioned angularly between two vanes 34. A first aperture 43 is positioned angularly between one quarter and one third of the way between the vanes 34, e.g. between 22.5° and 30° positions, and a second aperture 43 is positioned angularly at a position between two thirds and three quarters of the way between the vanes 34, e.g. between 60° and 67.5° positions.

If there are five vanes 34, each vane 34 is spaced 72° from the adjacent vanes 34 and there are ten apertures 43, two apertures 43 are positioned angularly between two vanes 34. A first aperture 43 is positioned angularly between one quarter and one third of the way between the vanes 34, e.g. between 18° and 24° positions, and a second aperture 43 is positioned angularly at a position between two thirds and three quarters of the way between the vanes 34, e.g. between 48° and 54° positions.

In summary, according to the present disclosure, the non-uniformities generated by the spray nozzle, in both the gas and the liquid flow, are taken into account, and used in such a way as to deliver a more uniform cloud of atomized droplets at the exit of the spray nozzle. In the particular scenario of a fuel spray nozzle, this in turn results in better combustion performance, but it will be appreciated that this will also bring advantages in other scenarios where consistency of droplet size is important, such as emissions control. Thus, although the embodiments discussed above all relate to the use of a spray nozzle in the context of a turbine engine, the invention is applicable in other fields too.

Figure 6:
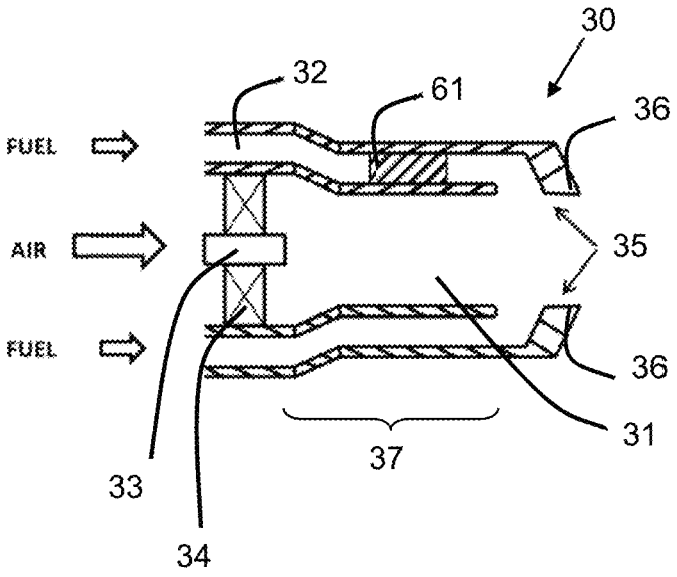
FIG. 6 is a sectional side view of a fuel spray nozzle showing a deflector in a liquid passage.

As will also be appreciated from the above, it is the supply of the bulk of the liquid to the areas on the prefilming surface 36 that receive the jet flow of gas that results in the improved atomisation. The control of the fuel supply to produce this effect can be done in any suitable way. For example, although the preceding discussion has focussed on angling the apertures 43 to provide the jets of liquid in a direction that leads to the bulk of the liquid being received in the areas of the prefilming surface 36 that also receive a jet flow of gas, other options are possible. For example, the liquid passages 32 themselves may include deflectors or barriers or guides (such as deflector 61 depicted in FIG. 6) that direct the bulk of the liquid passing through the liquid passage 32 to the areas on the prefilming surface that receive the jet flow of gas from the gas passage 31. Providing such deflectors may increase the non-uniformities in flow generated inside swirler 37, but may also allow better control of the flow and therefore an improved capacity to direct the bulk of the liquid to the desired regions on the prefilming surface 36. The deflectors 61 may be arranged in the same manner as described above with reference to the apertures for when the number of deflectors 61 is the same as the number of vanes 34 and alternatively for when the number of deflectors 61 is an integer multiple, e.g. two, of the number of vanes 34.

Figure 7:
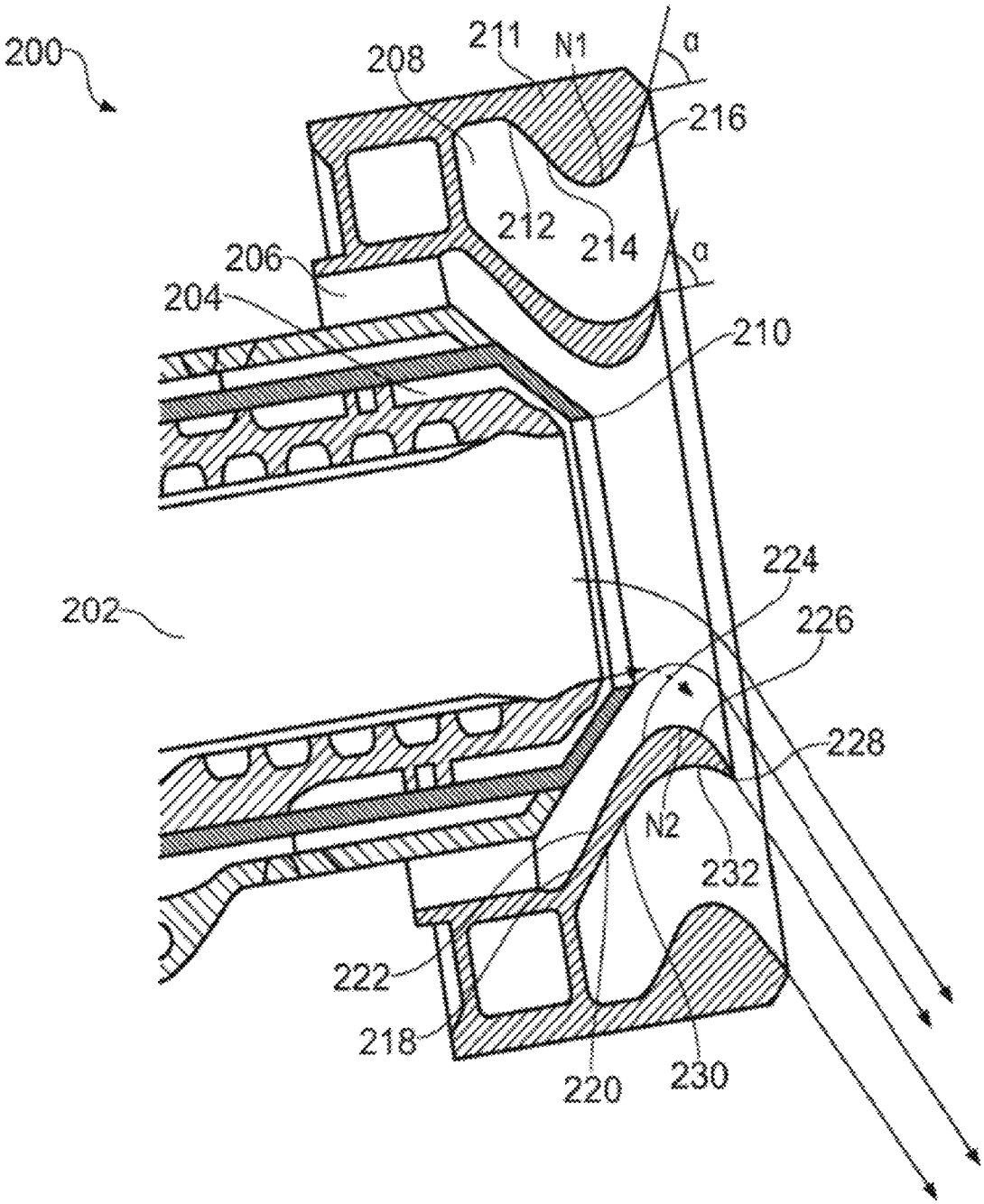
FIG. 7 is a schematic section of a rich burn airblast fuel injector.
Figure 8:
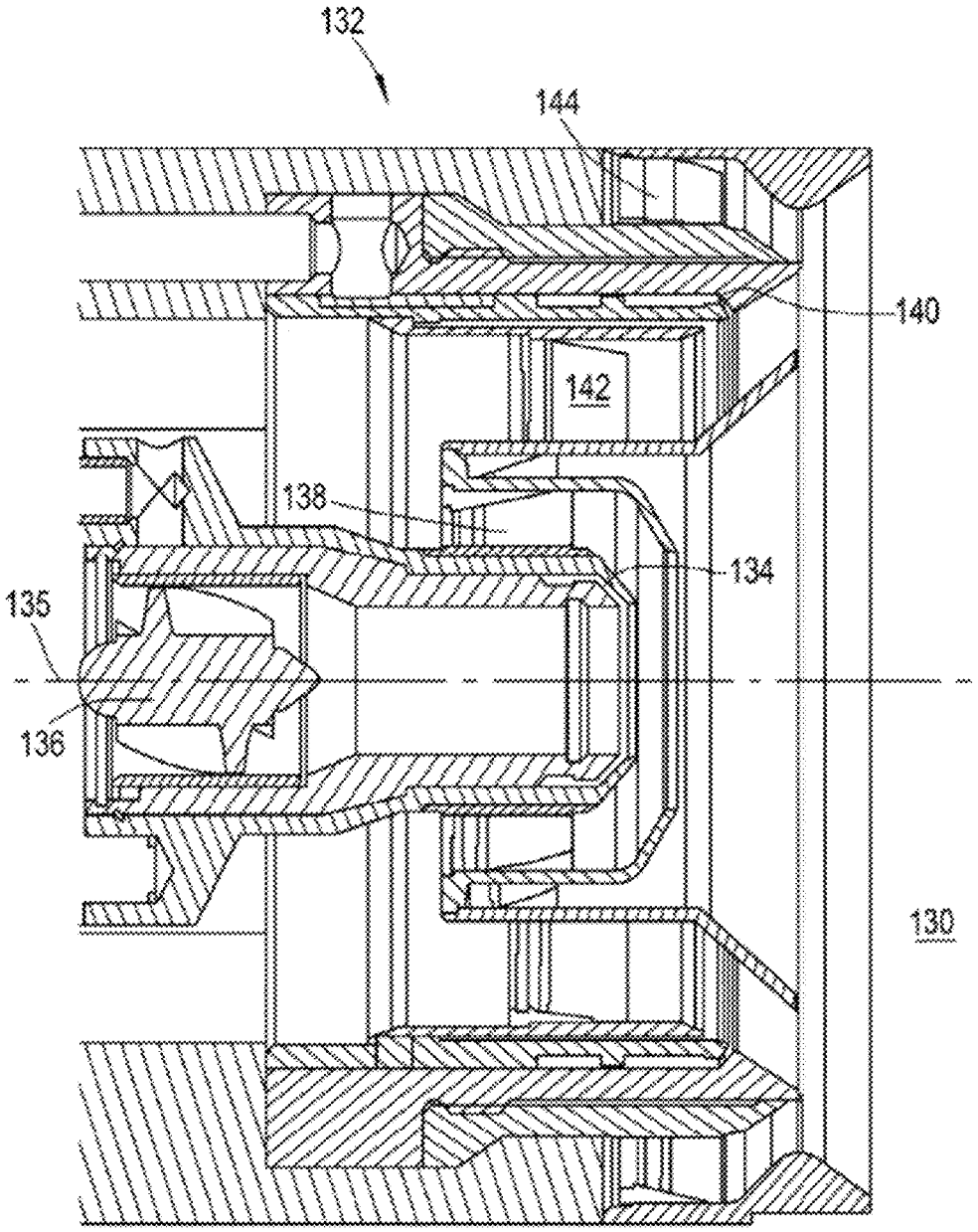
FIG. 8 is a schematic longitudinal cross section through a lean burn fuel spray nozzle.

The preceding description has discussed a particular fuel injector depicted with a central air passage, an annular fuel manifold and an annular pre-filming surface. However, the improvements discussed herein are also applicable to other types of fuel injectors, such as rich burn fuel injectors, which can have one or more additional air swirlers arranged concentrically around the arrangement of FIG. 2. The improvements are also applicable to lean burn fuel injectors, which have a pilot fuel manifold and a main fuel manifold each of which has a pre-filming surface and each fuel manifold is located concentrically between respective pairs of air swirlers, meaning there can be at least four air swirlers present. FIGS. 7 and 8 describe such alternative fuel injector nozzles, and the skilled person will readily understand how the previously discussed improvements can be applied to those arrangements so that the nozzles can be configured to direct the bulk of the liquid passing through a given liquid passage to areas on a corresponding prefilming surface that receive a jet flow of gas from a neighbouring gas passage.

FIG. 7 shows an example of a rich burn airblast fuel injector 200, which may be a pilot injector of a fuel spray nozzle, which can also have one or more annular mains fuel injectors radially outwardly of the pilot injector. The airblast fuel injector nozzle 200 has, in order from radially inner to outer, a coaxial arrangement of an inner air swirler passage 202, an annular fuel passage 204, an annular outer air swirler passage 206, and an annular shroud air swirler passage 208. The fuel passage 204 feeds fuel to a prefilming lip 210. Swirling air flow entrains the fuel on the prefilming lip 210 into a fuel spray (indicated generally by the thick, dotted, arrowed line in FIG. 7), the fuel being atomised into a spray by the surrounding swirling air flows (indicated generally by the thick, solid, arrowed lines in FIG. 7) exiting the inner, outer and shroud air passages 202, 206 and 208 respectively. Mixing of air flows from all three air swirler passages 202, 206 and 208 is desirable to minimise smoke and emissions. With distance from the prefilming lip 210, the fuel spray expands outwardly in a cone of well-atomised fuel droplets.

The airblast fuel injector 200 has an annular shroud 211, an inner surface profile 212 of which defines a radially outer side of the shroud air passage 208. Relative to the overall axial direction of flow through the airblast fuel injector 200, the shroud inner surface profile 212 has a convergent section 214 corresponding to a convergent portion of the shroud air swirler passage 208. The convergent section 214 of the shroud inner surface profile 212 is followed by a divergent section 216, and the transition from the convergent section 214 to the divergent section 216 of the shroud inner surface profile 212 forms a first inwardly directed annular nose N1. This first inwardly directed annular nose N1 directs the shroud air flow radially inwards, creating shear layers between the air flows and promoting turbulent mixing.

The airblast fuel injector 200 further has an annular wall 218 having an outer surface profile 220 which defines a radially inner side of the shroud air passage 208, and having an inner surface profile 222 which defines a radially outer side of the outer passage 206.

Relative to the overall axial direction of flow through the airblast fuel injector 200, the wall outer surface profile 220 has a convergent section 230 corresponding to the convergent section 214 of the shroud air passage 208, followed by an outwardly turning section 232 which faces across the shroud air swirler passage 208 to the first nose N1. The outwardly turning section 232 reduces or prevents flow separation in the shroud air swirler passage 208 from the wall outer surface profile 220. In this way, combustion can be prevented from occurring in this region, allowing metal temperatures of the annular wall 218 to be kept within acceptable limits.

The outwardly turning section 232 of the wall outer surface profile 220 may also be shaped so that, on longitudinal cross-sections through the airblast fuel injector 200, the shroud air swirler passage 208 maintains a substantially constant width as it turns around the nose N1. Advantageously, the constant width helps to prevent restriction of the air flow through the shroud air swirler passage 208, which might otherwise cause early combustion and undesirably high metal temperatures.

The wall inner surface profile 222 also has a convergent section 224 corresponding to a convergent portion of the outer air swirler passage 206. The convergent section 224 of the wall inner surface profile 222 is followed by a divergent section 226, and the transition from the convergent section 224 to the divergent section 226 of the wall forms a second inwardly directed annular nose N2. The divergent section 226 of the wall inner surface profile 222 and the divergent section 216 of the shroud inner surface profile 212 may have substantially the same conic angle $\alpha$. The radius of curvature of the nose N2 is preferably the largest possible compatible with providing the same conic angle $\alpha$, and with retaining a length and width of the convergent portion of the outer air swirler passage 206 similar to those found in a conventional airblast fuel injector.

FIG. 8 shows schematically a longitudinal cross section through a lean burn fuel spray nozzle 132 which injects a pilot flow of air and fuel and a mains flow of air and fuel into a combustor 130. The nozzle comprises a pilot airblast fuel injector having an annular fuel passage 134 which allows the fuel to flow as a film on an annular prefilmer surface. A pilot inner swirler 136 located on the centreline 135 of the nozzle and a pilot outer swirler 138, are used to swirl air past the film, causing the liquid fuel to be atomized into small droplets.

The fuel spray nozzle 132 further includes a mains airblast fuel injector which is coaxially located about the pilot airblast fuel injector. The mains airblast fuel injector has inner 142 and outer 144 main swirlers which are located coaxially inward and outward of a mains fuel passage 140.

All four swirlers 136, 138, 142 and 144 are fed from a common air supply system, and the relative volumes of air which flow through each of the swirlers are dependent upon the sizing and geometry of the swirlers and their associated air passages. Each swirler comprises a circumferential row of vanes. The two swirlers of each of the pilot and the mains fuel injectors may be either co-swirl or counter-swirl.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A fuel spray nozzle, for atomising liquid fuel in a gas, comprising:

a gas passage;

a swirler provided in the gas passage and comprising vanes configured to produce a jet flow of gas from between adjacent vanes and a turbulent flow of gas in a wake of each vane;

a liquid fuel passage disposed radially outward of i) the gas passage and ii) the vanes and separated from the gas passage by a solid wall; and a prefilming surface disposed downstream of the vanes, the prefilming surface configured to receive liquid fuel from the liquid fuel passage, and to receive gas from the gas passage, wherein the prefilming surface comprises first areas configured to receive the jet flow of gas from the gas passage and second areas configured to receive the turbulent flow of gas from the gas passage, the fuel spray nozzle comprises apertures disposed downstream of the vanes and configured to control a supply of the liquid fuel to the liquid fuel passage, and the fuel spray nozzle is configured to direct the liquid fuel passing through the apertures and the liquid fuel passage to the first areas on the prefilming surface, and an angle of each of the apertures relative to a center line of the gas passage is the same as an angle of a surface of each of the vanes relative to the center line of the gas passage.

2. The fuel spray nozzle according to claim 1, wherein the apertures are configured to direct liquid fuel through the liquid fuel passage to the first areas on the prefilming surface that receive the jet flow of gas from the gas passage.

3. The fuel spray nozzle according to claim 1, wherein a number of the apertures is the same as a number of the vanes, and wherein each aperture is positioned angularly between 40% and 60% of a circumferential distance, between the adjacent vanes.

4. The fuel spray nozzle according to claim 1, wherein a number of the apertures is an integer multiple of a number of the vanes, and a plurality of the apertures are positioned angularly between the adjacent vanes.

5. The fuel spray nozzle according to claim 4, wherein each of the plurality of the apertures positioned angularly between the adjacent vanes is positioned angularly at a position between one quarter and three quarters of a circumferential distance between the adjacent vanes and the apertures positioned angularly between the adjacent vanes are angularly spaced.

6. The fuel spray nozzle according to claim 1, further comprising deflectors within the liquid fuel passage.

7. The fuel spray nozzle according to claim 6, wherein the deflectors are configured to direct liquid fuel through the liquid fuel passage to the first areas on the prefilming surface that receive the jet flow of gas from the gas passage.

8. The fuel spray nozzle according to claim 1, wherein the gas passage and the liquid fuel passage are concentric.

9. The gas turbine engine incorporating the fuel spray nozzle according to claim 1.

10. The fuel spray nozzle according to claim 1, wherein the prefilming surface is disposed downstream of the vanes at an axial end of the fuel spray nozzle.

11. A method of atomising liquid fuel in gas, comprising the steps of:

supplying gas to a prefilming surface via a swirler provided in a gas passage, the swirler comprising vanes such that, when gas passes through the gas passage, the swirler produces a jet flow of gas from between adjacent vanes and a turbulent flow of gas in a wake of each vane, the prefilming surface being disposed downstream of the vanes, the prefilming surface comprising first areas configured to receive the jet flow of gas from the gas passage and second areas configured to receive the turbulent flow of gas from the gas passage;

supplying liquid fuel to the prefilming surface via a liquid fuel passage and apertures for supplying the liquid fuel to the liquid fuel passage, the liquid fuel passage being disposed radially outward of i) the gas passage and ii) the vanes and separated from the gas passage by a solid wall, and the apertures being disposed downstream of the vanes; and directing a portion of the liquid fuel passing through the apertures and the liquid fuel passage to the first areas on the prefilming surface.

12. The method of atomising liquid in gas according to claim 11, wherein the step of supplying comprises supplying the liquid fuel from the liquid fuel passage to the prefilming surface, wherein the liquid fuel passage comprises deflectors that are configured to direct the liquid fuel through the liquid fuel passage to the first areas on the prefilming surface that receive the jet flow of gas from the gas passage.

13. The method of atomising liquid in gas according to claim 11, wherein the prefilming surface is disposed downstream of the vanes at an axial end of a fuel spray nozzle comprising the vanes.

* * * * *